US006293355B1

(12) United States Patent
Koivunen et al.

(10) Patent No.: US 6,293,355 B1
(45) Date of Patent: Sep. 25, 2001

(54) METHOD OF CONTROLLING ROCK DRILLING

(75) Inventors: Pertti Koivunen, Tampere; Simo Sanerma, Lempäälä ; Erkki Eilo, Pirkkala, all of (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 09/423,903

(22) PCT Filed: May 29, 1998

(86) PCT No.: PCT/FI98/00459

§ 371 Date: Jan. 19, 2000

§ 102(e) Date: Jan. 19, 2000

(87) PCT Pub. No.: WO98/57034

PCT Pub. Date: Dec. 17, 1998

(30) Foreign Application Priority Data

Jun. 9, 1997 (FI) ..... 9722447

(51) Int. Cl.[7] ..... E21B 44/00

(52) U.S. Cl. ..... 175/26; 702/9

(58) Field of Search ..... 175/26, 24, 45, 175/424, 60, 61, 71, 92; 166/259; 33/304, 306, 308, 313; 702/9

(56) References Cited

U.S. PATENT DOCUMENTS

| | | | | |
|---|---|---|---|---|
| 3,667,555 | * | 6/1972 | Elenburg | 175/60 |
| 4,269,449 | * | 5/1981 | Del Rio | 299/2 |
| 4,639,868 | | 1/1987 | Tanaka et al. . | |
| 5,314,030 | * | 5/1994 | Peterson et al. | 175/26 |

FOREIGN PATENT DOCUMENTS

| | | |
|---|---|---|
| 44 45 420 | 2/1995 | (DE) . |
| 41004 | 7/1968 | (FI) . |
| 2 181 077 A | 4/1987 | (GB) . |
| WO 92/06276 | 4/1992 | (WO) . |

* cited by examiner

*Primary Examiner*—Robert E. Pezzuto
(74) *Attorney, Agent, or Firm*—Burns, Doane, Swecker & Mathis, L.L.P.

(57) ABSTRACT

A method of controlling rock drilling wherein the cut length changes from a predetermined cut length, the drilling length is changed by transferring the position of the pattern in the longitudinal direction of the tunnel so that the positions of the end points of the holes remain essentially the same with respect to one another, and a collaring surface is crosswise of the tunnel and different from the actual rock surface.

17 Claims, 2 Drawing Sheets

METHOD OF CONTROLLING ROCK DRILLING

FIELD OF INVENTION

The invention relates to a method of controlling rock drilling when holes are drilled on the basis of the cross-section of a tunnel in accordance with a predetermined length, the position and length of each hole to be drilled being defined in a three-dimensional coordinate system, and the starting point of each hole in the collaring surface, which is crosswise of the tunnel and is different from the actual rock surface, being defined, and the direction and lengths of the holes of the drilling pattern being defined in accordance with an advance plan so that the positions of the end points of the holes in relation to one another are predetermined.

BACKGROUND AND SUMMARY OF THE INVENTION

The method used in making tunnels or apertures in the rock is one in which holes are drilled in the rock to be blasted in accordance with a predefined drilling pattern so that when the explosives are inserted in the holes blast, a block of a desired depth and direction is detached from the rock. The direction and the position of the holes are important when the rock is to be broken in exactly the desired manner and in sufficiently small blocks. A problem here is that when, for example, the direction of the tunnel changes or when the conditions change otherwise, 'cuts' with different blasting depths, or advance lengths, are used. For each cut of a different length, a different drilling pattern is used to achieve the desired final result. For example, when automatic drilling equipment is used, a separate drilling pattern is used for each normal cut depth, and so the equipment must have much more storage capacity, which requires a complicated structure. Further, it is also frustrating to the designer and the user of the equipment that many drilling patterns are so close to one another.

The object of the invention is to provide a method by which the drawbacks of the previously known, presently used method are avoided, and an appropriate drilling operation can be conducted in a simple and easy manner in accordance with the cut length. The method of the invention is characterized in that when the drilling depth needed for the blasting differs from said predetermined blasting depth, the drilling length in the drilling pattern is changed by transferring the position of the pattern in the longitudinal direction of the tunnel in accordance with the change in the blasting depth so that the positions of the end points of the holes in said three-dimensional coordinate system are transferred by said length but remain essentially the same in respect of one another, and that said collaring surface, where the collaring points of the holes are defined, is maintained the same so that the distance between the end points of the holes and said collaring surface in the longitudinal direction of the tunnel changes by the change in said blasting length.

The essential idea of the invention is that a drilling pattern is defined for a tunnel with a cross-section of a certain type and size, the drilling pattern defining the starting point of each hole in the collaring surface, or usually level, which is crosswise of the tunnel and is defined for the collaring, and the direction and length of each hole and thereby the end point of each hole. Another essential idea of the invention is that when the drilling depth, or cut length, changes so that it is shorter or longer than the normal full blasting length, the position of the drilling pattern is transferred forward or backward from the original position in the longitudinal direction of the tunnel so that the mutual relations between the end points of the holes do not change but settle in accordance with the desired cut length in relation to the rock. Yet another essential idea is that the position of the collaring surface is maintained the same, but a new starting position is calculated for each hole in the collaring surface, or the direction from the collaring surface to the end point is maintained in accordance with the original drilling pattern.

It is an advantage of the invention that in the drilling of a tunnel or the like that has a certain shape, a single drilling pattern can be used in which the positions of all the holes in relation to one another are defined three-dimensionally. Further, when the cut length shortens or lengthens, the position of the drilling pattern is transferred from the position corresponding to the cut length, i.e. from the starting position, in the main drilling direction, i.e. toward the end of the drill holes, or in the opposite direction, simultaneously as the equipment automatically calculates, for each hole, a new starting point or direction from the collaring surface to the end points corresponding to the position of the transferred drilling pattern so that the position of that part of each hole which is to be drilled remains essentially in accordance with the original drilling pattern in relation to the other holes. The drilling pattern can thus be steplessly transformed to correspond to the desired cut length without separate drilling patterns dependent on the cut length. This simplifies the driller's work and the automatic drilling.

BRIEF DESCRIPTION OF THE DRAWINGS

The invention will be described in greater detail in the attached drawings, in which.

DETAILED DESCRIPTION OF THE PREFERRED EMBODIMENTS(s)

Figure 1A:
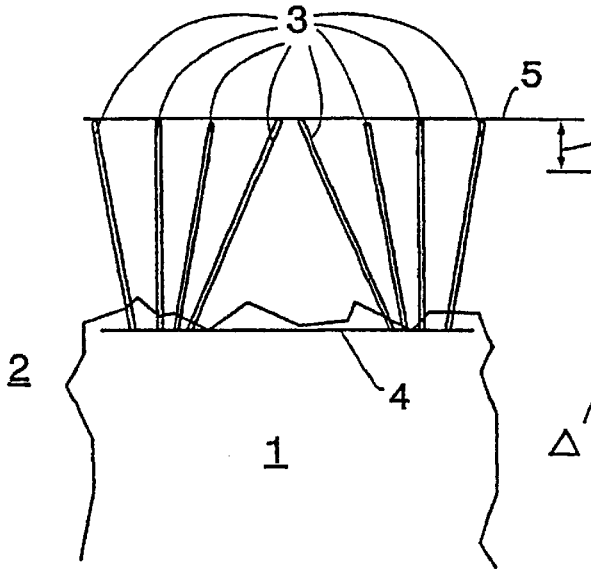
FIGS. 1*a* and 1*b* show a schematic view of an exemplary embodiment of a method according to the invention, showing, by way of an example, a top view of a row of holes of a simple drilling pattern in a normal cut and in a short cut, respectively.
Figure 1B:
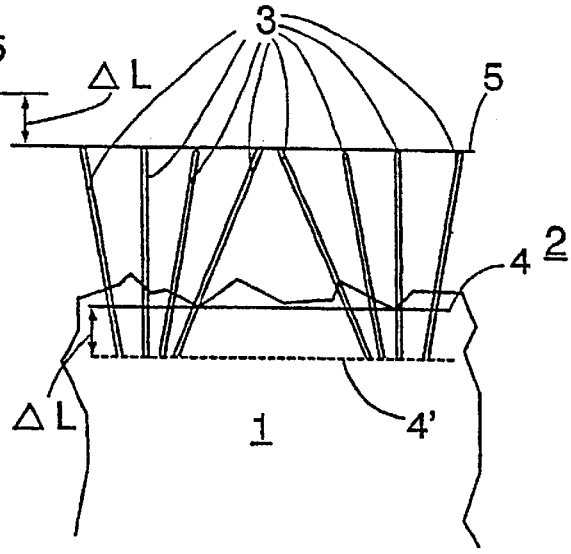

FIGS. 1*a* and 1*b* show a schematic view of an embodiment of a method according to the invention, showing, by way of an example, a top view of the shape and location of a drilling pattern in relation to the rock in a normal cut and a shorter cut, respectively. In the figures, drill holes are drilled at the end of a tunnel 1 in a rock 2 surrounding the tunnel, so that the rock can be blasted off in a desired manner. In FIG. 1*a*, the cut length is normal, whereby the whole length is as long as necessary for a cut to detach and break the rock. Both figures also show a collaring surface 4, in relation to which the direction and length of each hole 3*a* to 3*h* in the drilling pattern, starting from the collaring surface, and the starting point in the collaring surface are defined in a three-dimensional coordinate system. In the figure, a line 5 indicates a theoretical cut length, or the point where the drill holes end, in drilling patterns of this kind. In FIG. 1*b* the cut length $\Delta L$ shorter than in FIG. 1*a*, and, correspondingly, the hole length in the rock is to be blasted is $\Delta L$ shorter. In FIG. 1*a* the collaring surface 4 is thus located in a position where the drilling of each hole is defined appropriately in relation to the rock face in accordance with the normal full drilling length, i.e. maximal cut length.

FIG. 1*b*, in turn, shows a situation where there is a shorter cut due to the properties of the rock material or other such reasons. A normal position 4' of the collaring surface 4 would result in unduly long, empty distances, which in turn would result in inaccuracy and waste of time in the drilling, as compared with a standard situation. Consequently, the drilling pattern has been transferred in relation to the rock by $\Delta L$, which is the same as the difference in the drilling lengths of the drilling patterns. Correspondingly, when the position and location of the end points of the holes are to be maintained unchanged in relation to the starting points in the original collaring surface, the starting point of each hole in the collaring surface changes, in accordance with the direction of the hole either in the horizontal or vertical direction or in both, to the position 4' of the collaring surface according to the original, full-scale drilling pattern corresponding to FIG. 1*a*. In FIG. 1*b* most holes have a different collaring point from FIG. 1*a*, which appears in the comparison of the cross-section in the direction of the collaring surface 4 of the holes.

Figure 2A:
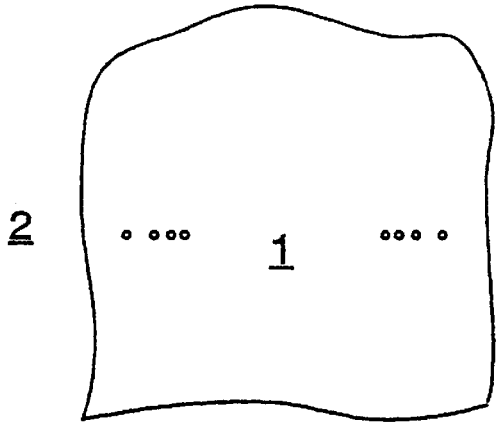
FIGS. 2*a* and 2*b* illustrate an embodiment of the method of FIG. 1, showing the location of the holes of the same drilling pattern in a tunnel in the drilling direction.
Figure 2B:
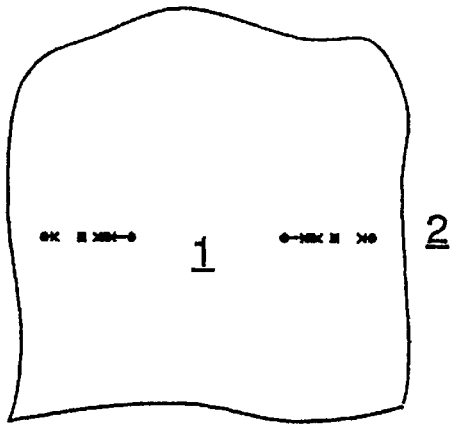

In FIG. 2*a*, small circles indicate the starting points of the holes of the drilling pattern corresponding to FIG. 1*a* in the collaring surface 4. FIG. 2*b*, in turn, shows a similar situation as FIG. 1*b*, in which the position of the drilling pattern has been transferred backward from the position corresponding to the normal cut length in relation to the rock. In this figure the circles indicate the changed starting point of each hole of the drilling pattern in the collaring surface 4, and the crosses connected to the circles by lines indicate the starting point of each hole of the original, full-scale drilling pattern corresponding to FIG. 1*a*.

Figure 3:
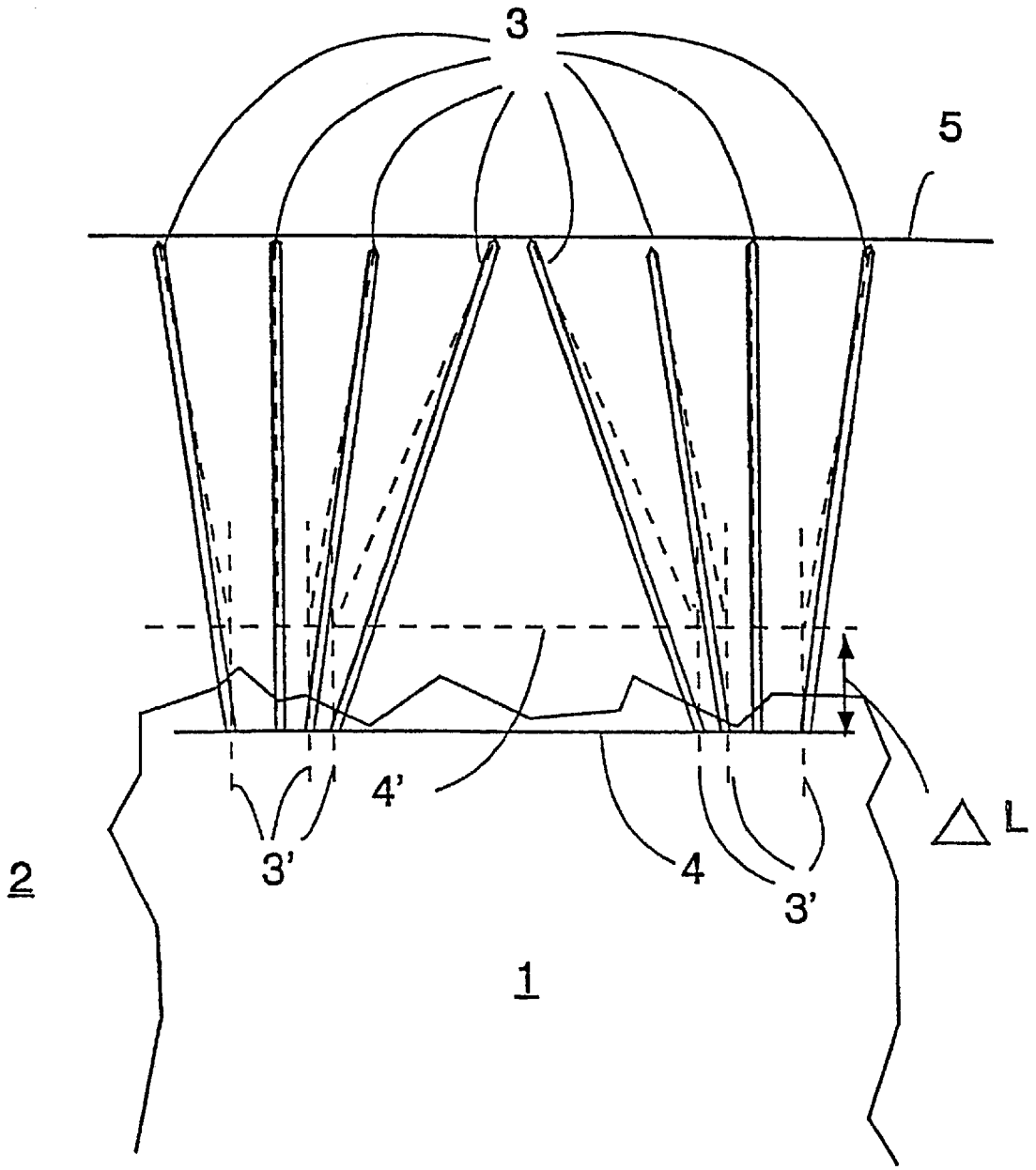
FIG. 3 shows, by way of an example, a schematic view of another embodiment of the method according to FIG. 1*a*, showing a top view of a normal cut and a longer cut corresponding to the drilling pattern.

FIG. 3 is a schematic view of another embodiment of a method according to the invention. The idea of the embodiment is that when the drilling pattern is transferred, the mutual relations of the starting points of the holes remain unchanged and, correspondingly, the mutual relations of the end points remain unchanged, and as the drilling pattern is transferred, the direction and drilling length of the holes are re-calculated as the direction of and the distance between the starting points and the end points.

FIG. 3 is a drilling pattern, showing a schematic top view of the holes of the drilling pattern corresponding to FIG. 1*a*. Like reference numbers indicate similarly as in FIG. 1. FIG. 3 shows how the drilling pattern shown in FIG. 1 is transformed when, for some reason or other, the cut length, or drilling length, must be lengthened. The dotted lines in FIG. 3 indicate the original direction of the drill holes in the original position 4' of the collaring surface corresponding to the normal length of the drilling pattern. The continuous lines, in turn, indicate the position of the holes and the collaring surface 4 in the lengthened drilling pattern. Parallel dotted lines 3' indicate that as the drilling pattern is transferred in relation to the rock, the starting points of the holes remain in the original positions in relation to the collaring surface 4. However, the direction and length of the holes in the drilling pattern change, and they are re-defined as the direction of and the distance between the starting points in the collaring surface 4 and the end points whose mutual relations have remained unchanged in the drilling pattern. Correspondingly, the cut length can be shortened or lengthened by transferring the drilling pattern backward or forward from the original position in relation to the rock, maintaining the starting points of the holes in the collaring surface 4 unchanged and by calculating a new direction and length from the starting points to the end points.

The invention is described in the specification and the drawings only by way of an example, and it is not to be understood as being limited thereto. The essential feature is that in a tunnel with a certain cross-section, the blasting can be carried out by using a single drilling pattern, the position of which is transferred in relation to the rock in the longitudinal direction of the drilling pattern from the position corresponding to a full-scale cut to the position corresponding to the actual cut length, and the length and direction of the drill holes or their new starting points, with the original direction toward the end points, are changed so that the end points of the holes to be actually drilled are in essentially the same position to one another as in a full-scale cut.

What is claimed is:

1. A method of controlling rock drilling when a plurality of holes are drilled based on a cross section of a tunnel in accordance with a predefined drilling pattern corresponding to a blasting depth of a predetermined length, a position and length of each of the plurality of holes to be drilled being defined in a three-dimensional coordinate system, and a starting point of each of the plurality of holes in a collaring surface, which is crosswise of the tunnel and is different from an actual rock surface, being defined, and a direction and the length of the plurality of holes of the drilling pattern being defined in accordance with an advanced plan so that positions of end points of the plurality of holes in relation to one another are predetermined, and when a drilling depth needed for the blasting differs from said predetermined blasting depth, a drilling length in the drilling pattern is changed by transferring the position of the pattern in a longitudinal direction of the tunnel in accordance with the change in the blasting depth so that the positions of the end points of the plurality of holes in said three-dimensional coordinate system are transferred by said length but remain essentially the same with respect to one another, and that said collaring surface, where the starting points of the plurality of holes are defined, is maintained the same so that the distance between the end points of the plurality of holes and said collaring surface in the longitudinal direction of the tunnel changes by the change in said blasting length.

2. A method according to claim 1, wherein when the drilling pattern is transferred to a transferred position, the positions of the plurality of holes in the drilling pattern are maintained the same in relation to one another in said three-dimensional coordinate system, and that a new starting point is defined for each of the plurality of holes in the transferred drilling pattern, the new starting point being located in the collaring surface, at the intersection of the collaring surface and the axis of each of the plurality of holes of the drilling pattern.

3. A method according to claim 1, wherein when the drilling pattern is transferred, the starting point of each of the plurality of holes is maintained the same in the collaring surface, and that a new direction and distance from the starting point of the plurality of holes in the collaring surface to the end points as defined by the drilling pattern is defined for each of the plurality of holes in the transferred position of the drilling pattern.

4. A method according to claim 2, wherein the drilling pattern is transferred steplessly in accordance with the depth to be blasted in the rock.

5. A method according to claim 2, wherein the drilling pattern is defined to be transferred at predetermined intervals.

6. A method according to claim 1, wherein the length of the drilling pattern is shortened.

7. A method according to claim 1, wherein the length of the drilling pattern is lengthened.

8. A method according to claim 3, wherein the drilling pattern is transferred steplessly in accordance with the depth to be blasted in the rock.

9. A method according to claim 3, wherein the drilling pattern is defined to be transferred at predetermined intervals.

10. A method according to claim 2, wherein the length of the drilling pattern is shortened.

11. A method according to claim 3, wherein the length of the drilling pattern is shortened.

12. A method according to claim 4, wherein the length of the drilling pattern is shortened.

13. A method according to claim 5, wherein the length of the drilling pattern is shortened.

14. A method according to claim 2, wherein the length of the drilling pattern is lengthened.

15. A method according to claim 3, wherein the length of the drilling pattern is lengthened.

16. A method according to claim 4, wherein the length of the drilling pattern is lengthened.

17. A method according to claim 5, wherein the length of the drilling pattern is lengthened.

* * * * *

UNITED STATES PATENT AND TRADEMARK OFFICE

CERTIFICATE OF CORRECTION

PATENT NO. : 6,293,355 B1
DATED : September 25, 2001
INVENTOR(S) : Pertti Koivunen et al.

It is certified that error appears in the above-identified patent and that said Letters Patent is hereby corrected as shown below:

Title page,
Item [30], Foreign Application Priority Data, "9722477" should be -- 972447 --

Signed and Sealed this

Fourth Day of June, 2002

*Attest:*

*Attesting Officer*

JAMES E. ROGAN
*Director of the United States Patent and Trademark Office*